US006827069B1

(12) United States Patent
Dudek et al.

(10) Patent No.: US 6,827,069 B1
(45) Date of Patent: Dec. 7, 2004

(54) DETECTION OF FUEL DYNAMICAL STEADY STATE

(75) Inventors: Kenneth P. Dudek, Rochester Hills, MI (US); Ronald A. Davis, Commerce Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/664,328

(22) Filed: Sep. 17, 2003

(51) Int. Cl.[7] ..... F02D 41/00

(52) U.S. Cl. ..... 123/681; 123/679; 123/494; 701/109; 73/116

(58) Field of Search ..... 123/681, 679, 123/494; 701/109, 104, 103; 73/116, 117.3

(56) References Cited

U.S. PATENT DOCUMENTS 4,360,161 A * 11/1982 Claxton et al. ..... 239/463
5,423,208 A * 6/1995 Dudek et al. ..... 73/117.3
5,541,393 A * 7/1996 Ikezawa et al. ..... 235/98 R
5,642,722 A * 7/1997 Schumacher et al. ..... 123/673
5,819,714 A * 10/1998 Bush et al. ..... 123/673

* cited by examiner

*Primary Examiner*—John T. Kwon
(74) *Attorney, Agent, or Firm*—Christopher DeVries

(57) ABSTRACT

An engine control system that identifies fuel dynamical steady state (FDSS) includes a cylinder and a controller that determines a detection period. The controller monitors a mass of fuel ingested by the cylinder during the detection period. The controller identifies FDSS if the mass of fuel remains within a predetermined range during the detection period.

34 Claims, 2 Drawing Sheets

DETECTION OF FUEL DYNAMICAL STEADY STATE

FIELD OF THE INVENTION

The present invention relates to engine system operation, and more particularly to identifying fuel dynamical steady state (FDSS) of an engine system.

BACKGROUND OF THE INVENTION

Automotive engines are complex dynamic systems. Performance of the engine is influenced by a number of parameters such as fuel offset, commanded fuel, actual fuel, commanded mass of air, actual mass of air and/or other parameters. The engine parameters are monitored to evaluate and adjust engine performance. The engine parameters provide observable engine system characteristics. Observation of the engine characteristics enables more accurate operation and control of the engine.

Fuel dynamical steady state (FDSS) presents a special operating condition of the engine. FDSS is an engine state during which measured fuel is nearly constant except for relatively small periodic fluctuations, which are a characteristic of fuel feedback control systems. Traditional monitoring systems do not identify FDSS during operation of the engine. As a result, observable engine characteristics are lost.

SUMMARY OF THE INVENTION

Accordingly, the present invention provides an engine control system that identifies fuel dynamical steady state FDSS. The engine control system includes an engine having one or more cylinders and a controller that sets a detection period. The controller monitors a mass of fuel ingested by the cylinder during the detection period. The controller identifies FDSS if the mass of fuel remains within a predetermined range during the detection period.

In one feature, the mass of fuel is a measured mass of fuel. Alternatively, the mass of fuel is a commanded mass of fuel.

In another feature, the controller monitors an air to fuel (A/F) ratio within the cylinder and monitors a mass of air ingested by the cylinder. The mass of fuel is based on the A/F ratio and the mass of air ingested by the cylinder.

In still another feature, the controller determines an average mass of fuel for the detection period. The predetermined range is based on the average mass of fuel. The predetermined range includes a lower limit based on the average mass of fuel and a steady state threshold. The predetermined range includes an upper limit based on the average mass of fuel and a steady state threshold.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
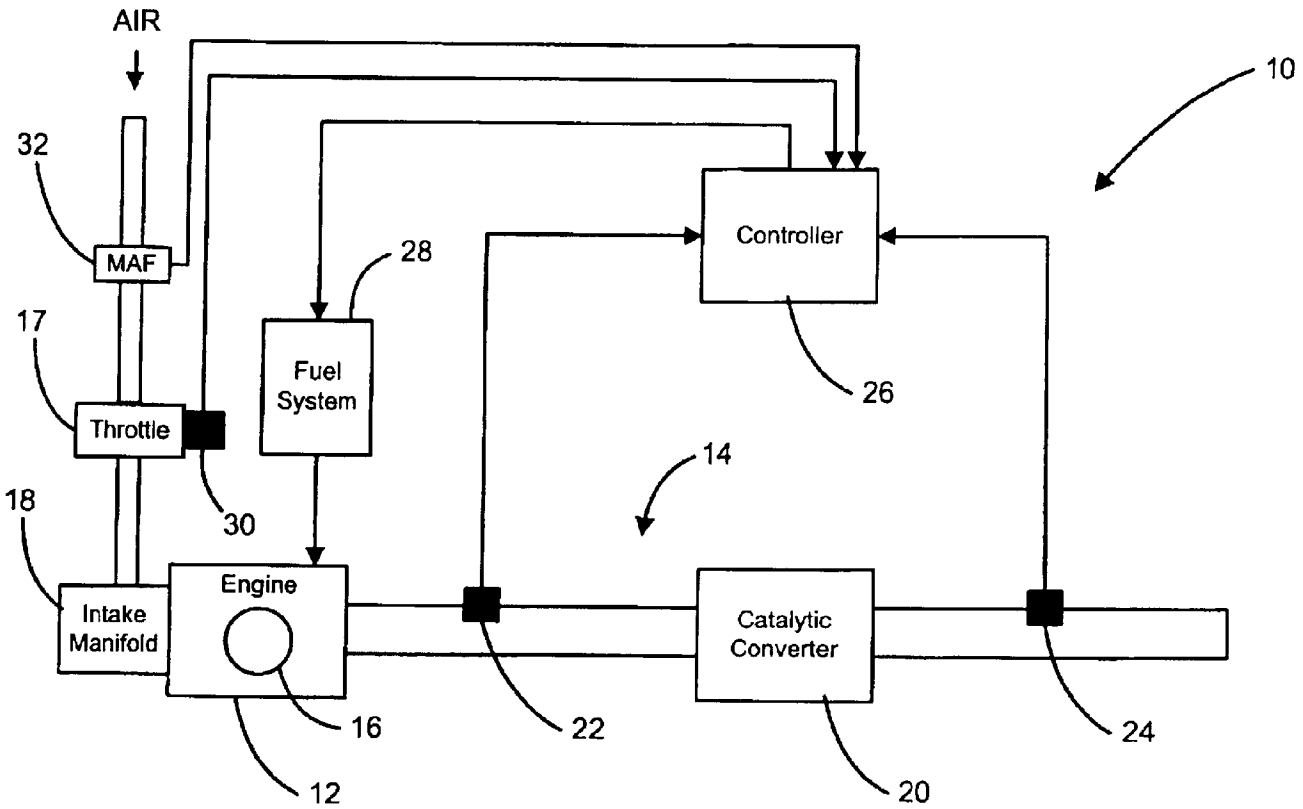
FIG. 1 is a functional block diagram of an engine system implementing a fuel dynamical steady state (FDSS) controller according to the present invention.

The following description of the preferred embodiments is merely exemplary in nature and is in no way intended to limit the invention, its application, or uses. For purposes of clarity, the same reference numbers will be used in the drawings to identify similar elements.

Referring now to FIG. 1, an engine 10 includes an engine 12 and an exhaust 14. The engine 12 includes cylinders 16. Although the engine 12 is shown to include a single cylinder 16, it is anticipated that the engine 12 can be a multi-cylinder engine having 2, 3, 4, 5, 6, 8, 10, 12, 16 or other numbers of cylinders. Air is metered by a throttle 17 through an intake manifold 18 into the engine 12. The exhaust 14 includes a catalytic converter 20, a pre-catalyst or inlet oxygen ($O_2$) sensor 22 and a post-catalyst or outlet $O_2$ sensor 24. The inlet $O_2$ sensor 22 generates a signal indicating the air to fuel (A/F) ratio of the exhaust stream from the engine 12.

A controller 26 monitors and controls operation of the engine 12. The inlet and outlet $O_2$ sensors 22, 24 communicate with the controller 26 to provide inlet and outlet A/F ratio signals, respectfully. The controller 26 communicates with a fuel system 28 to regulate fuel flow to the engine 12. In this manner, the controller 26 regulates the A/F ratio of the engine 12. A throttle position sensor (TPS) 30 and a mass air flow (MAF) sensor 32 communicate with the controller 26. The TPS 30 generates a throttle position signal and the MAF sensor 32 generates a MAF signal. The MAF signal indicates the amount of air entering the intake manifold 18 during an engine cycle.

The controller 26 monitors the signals of the various sensors to determine when the engine 12 is operating in fuel dynamical steady state (FDSS). FDSS occurs when a mass of fuel is approximately constant except for small, periodic fluctuations, which are a characteristic of fuel feedback control systems. When the engine 12 is operating in FDSS, changes in the mass of fuel that occur as a result of cylinder air rate changes and fuel dynamics have subsided. As described in further detail below, the mass of fuel can be a measured mass of fuel ($MF_M$) or a commanded mass of fuel ($MF_C$).

The controller 26 determines the existence of FDSS based on the monitored mass of fuel over a predetermined period and a steady state threshold ($FS_T$). The controller 26 determines an average value of the mass of fuel ($MF_{AVG}$) over the predetermined period. The controller 26 uses $FS_T$ to determine upper and lower limits of an FDSS range. The upper and lower limits are preferably based on a percentage of $MF_{AVG}$. The upper and lower limits need not be symmetric with respect to $MF_{AVG}$. Each mass of fuel data point recorded within a predetermined period is compared to the FDSS range. If all of the mass of fuel data points lie within the FDSS range, the engine 12 is deemed to be operating in FDSS during the predetermined period.

Typically, $FS_T$ is a predetermined value that is preprogrammed into memory. $FS_T$ is determined off-line and is based on $MF_{AVG}$. More particularly, $MF_{AVG}$ for a particular vehicle is determined from recorded data. The data is reviewed to determine periods of steady state operation. $FS_T$ is chosen to define the steady state range such that each of the MF data points fall within the steady state range.

It is anticipated, however, that $FS_T$ may be updated by the controller 26 during operation of the engine system 10. For example, the controller 26 can monitor the MF data and vary $FS_T$ to expand or constrict the steady state range. In this manner, certain periods of engine operation that had previously been considered as FDSS can be eliminated and/or periods that were not previously considered as FDSS can be included. Alternatively, the controller 26 can select $FS_T$ based on the operating conditions of the engine system 10. For example, the controller 26 can schedule $FS_T$ based on operating parameters such as engine speed (RPM) and manifold absolute pressure (MAP). In other words, for a given RPM and MAP, a corresponding value for $FS_T$ is selected. In this manner, the steady state range varies based on vehicle operation.

As mentioned above, the mass of fuel can be provided as $MF_M$ or $MF_C$. $MF_M$ is estimated by the controller 26 using an estimator. The estimator is processed by the controller 26, which estimates $MF_M$ based on various signals. Generally, $MF_M$ is determined based on estimated cylinder air mass and a measured A/F ratio. The cylinder air mass is estimated using standard volumetric efficiency. The standard volumetric efficiency is determined using a look-up table based on MAP or other engine parameters such as RPM. The A/F ratio is measured using a wide range A/F sensor (not shown) or a standard switching oxygen sensor (not shown). $MF_M$ for a particular engine event is determined after the occurrence of that engine event. $MF_C$ is the mass of fuel that the controller 26 uses to command engine operation. $MF_C$ is determined by the controller 26 based on the various signals and other engine parameters. $MF_C$ for a particular engine event is determined immediately prior to the occurrence of that engine event.

With regard to $MF_M$, the controller 26 can determine the existence of FDSS in either an on-line or off-line mode. The on-line mode is defined as reviewing the various signals in real-time during engine operation. The off-line mode is defined as reviewing the various signals at some point after engine operation has ceased. This may occur in a testing situation whereby engine data is recorded during engine operation and reviewed during post-test analysis.

For the on-line mode, the controller 26 determines the existence of FDSS according to the following relationship:

$$MF_{AVG}(k)\cdot(1.0-FS_T)<MF_{MS}(k-j)<MF_{AVG}(k)\cdot(1.0+FS_T)$$

for j=0, 1, . . . , n−1 where:

$MF_{MS}(k)$=shifted measured mass of fuel; and n=predetermined period (monitoring window)

If this relationship is true for a particular range of data, then the range is deemed to be in FDSS. $MF_{MS}(k)$ is shifted to be contemporaneous with the resulting A/F ratio (A/F). $MF_{MS}(k)$ is determined based on the a shifted mass of air ingested by the cylinder 16 ($GPO_S$) and the resulting A/F according to the following equation:

$$MF_{MS}(k)=\left(\frac{GPO_S(k)}{A/F(k)}\right)$$

The mass of air ingested by the cylinder 16 must be shifted to be contemporaneous with the resulting A/F ratio measured by the inlet sensor 22. This is because the resulting A/F ratio depends upon the mass of air originally ingested by the cylinder 16 for the particular engine event k.

For an off-line situation, the controller 26 determines the existence of FDSS according to the following relationship:

$$MF_{AVG}(k)\cdot(1.0-FS_T)<MF_M(k-j)<MF_{AVG}(k)\cdot(1.0+FS_T)$$

for j=0, 1, . . . , n−1

If this relationship is true for a particular range of data, then the range is in FDSS. $MF_M(k)$ is determined based on the a mass of air ingested by the cylinder 16 (GPO) and the resulting A/F ratio ($A/F_S$) according to the following equation:

$$MF_M(k)=\left(\frac{GPO(k)}{A/F_S(k)}\right)$$

The A/F ratio is shifted to be contemporaneous with the mass of air ingested by the cylinder 16. As similarly described above, this is because the resulting A/F ratio depends upon the mass of air originally ingested by the cylinder 16 for the particular engine event k.

In the case of $MF_C$, FDSS is determined according to the following relationship:

$$MF_{AVG}(k)\cdot(1.0-FS_T)<MF_C(k-j)<MF_{AVG}(k)\cdot(1.0+FS_T)$$

for j=0, 1, . . . , n−1

If this relationship is true for a particular period of data, then the period is deemed to be one of FDSS. $MF_C$ is determined by the controller 26 as described above. Thus, GPO and A/F signals are not required.

Figure 2:
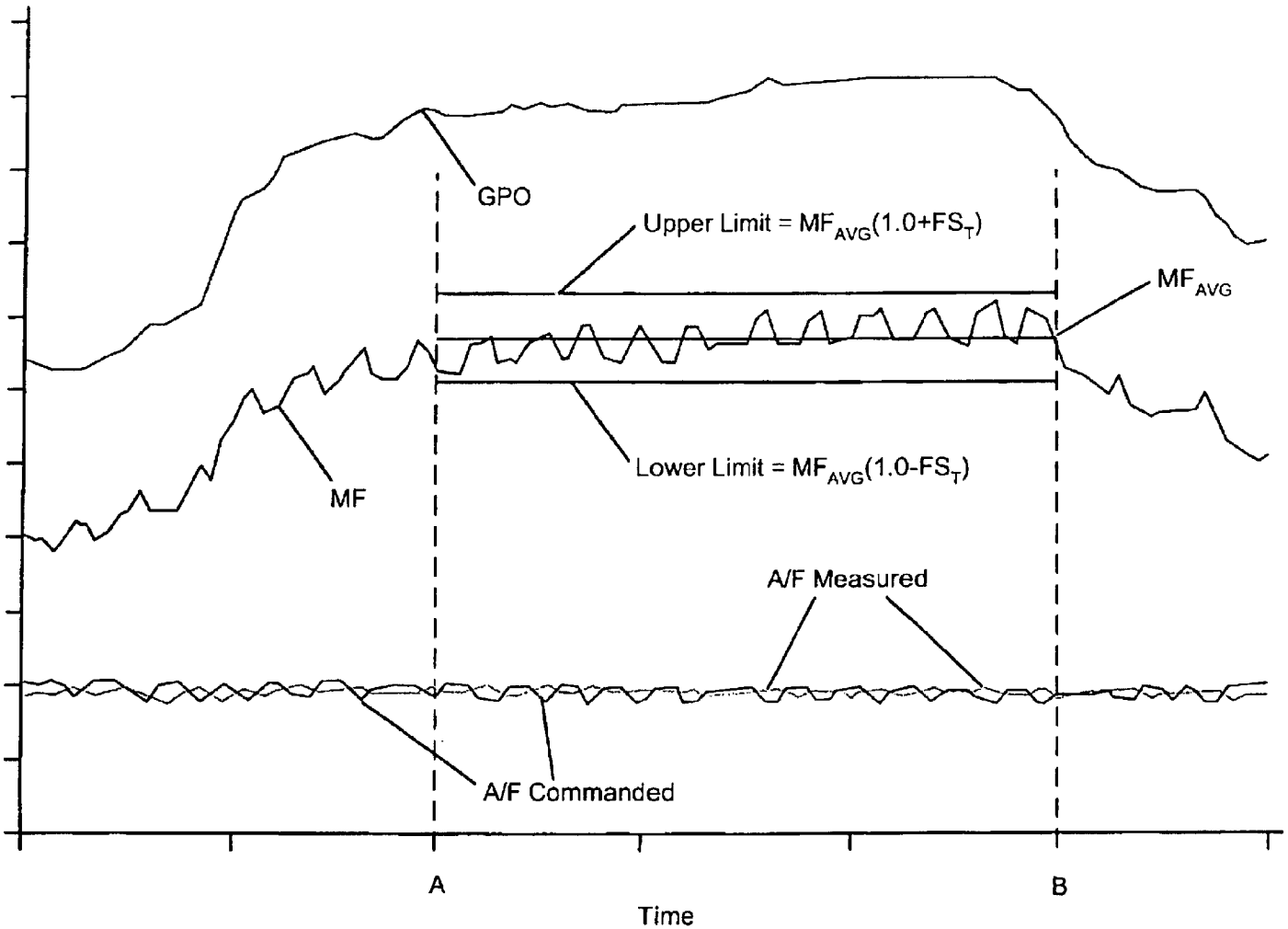
FIG. 2 is a graph illustrating an exemplary mass of fuel (MF) signal, an air to fuel (A/F) ratio signal and a mass of air ingested by an engine cylinder (GPO) signal of the engine system.

Referring now to FIG. 2, exemplary signals are shown and include GPO, MF, A/F measured and A/F commanded. $MF_{AVG}$ is shown between times A and B. The upper and lower limits that define the FDSS range are also shown. Each of the MF data points for the predetermined period defined by A and B are within the steady state range. Therefore, FDSS is present during the predetermined period defined by A and B.

Although the controller 26 is described as determining the occurrence of FDSS during operation of the engine system 10, it is anticipated that an external processor (not shown) can determine FDSS. That is to say, the engine system 10 itself can determine periods of FDSS or a diagnostic center reviewing operation of the engine system 10 can determine periods of FDSS. For example, recorded engine operation parameters can be downloaded to the external processor. The external processor reviews the recorded engine operation parameters to determine occurrences of FDSS.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine control system that identifies fuel dynamical steady state (FDSS), comprising:

an engine including at least one cylinder; and a controller that determines a detection period, monitors a mass of fuel ingested by said cylinder during said detection period and indicates FDSS if said mass of fuel remains within a predetermined range during said detection period.

2. The engine system of claim 1 wherein said mass of fuel is a measured mass of fuel.

3. The engine system of claim 1 wherein said mass of fuel is a commanded mass of fuel.

4. The engine system of claim 1 wherein said detection period is at least one engine cycle.

5. The engine system of claim 1 wherein said controller monitors an air to fuel (A/F) ratio within said cylinder and monitors a mass of air ingested by said cylinder.

6. The engine system of claim 5 wherein said mass of fuel is based on said A/F ratio and said mass of air ingested by said cylinder.

7. The engine system of claim 5 wherein said A/F ratio is shifted to be contemporaneous with an intake event of said cylinder during a current engine cycle.

8. The engine system of claim 5 wherein said mass of air ingested is shifted to be contemporaneous with a current A/F ratio.

9. The engine system of claim 1 wherein said controller determines an average mass of fuel for said detection period.

10. The engine system of claim 9 wherein said predetermined range is based on said average mass of fuel.

11. The engine system of claim 9 wherein said predetermined range includes a lower limit based on said average mass of fuel and a steady state threshold.

12. The engine system of claim 9 wherein said predetermined range includes an upper limit based on said average mass of fuel and a steady state threshold.

13. The engine system of claim 1 wherein said predetermined range is based on a steady state threshold.

14. The engine system of claim 13 wherein said steady state threshold is based on an average of said mass of fuel.

15. A method of identifying fuel dynamical steady state (FDSS) of an engine having at least one cylinder, comprising:

determining a detection period;

monitoring a mass of fuel ingested by said cylinder during said detection period; and indicating FDSS if said mass of fuel remains within a predetermined range during said detection period.

16. The method of claim 15 wherein said mass of fuel is a measured mass of fuel.

17. The method of claim 15 wherein said mass of fuel is a commanded mass of fuel.

18. The method of claim 15 wherein said detection period is at least one engine cycle.

19. The method of claim 15 further comprising:

monitoring an air to fuel (A/F) ratio within said cylinder; and monitoring a mass of air ingested by said cylinder.

20. The method of claim 19 wherein said mass of fuel is based on said A/F ratio and said mass of air ingested by said cylinder.

21. The method of claim 19 wherein said A/F ratio is shifted to be contemporaneous with an intake event of said cylinder during a current engine cycle.

22. The method of claim 19 wherein said mass of air ingested is shifted to be contemporaneous with a current A/F ratio.

23. The method of claim 15 further comprising determining an average mass of fuel for said detection period.

24. The method of claim 23 wherein said predetermined range is based on said average mass of fuel.

25. The method of claim 23 wherein said predetermined range includes a lower limit based on said average mass of fuel and a steady state threshold.

26. The method of claim 23 wherein said predetermined range includes an upper limit based on said average mass of fuel and a steady state threshold.

27. A method of identifying fuel dynamical steady state (FDSS) of an engine having a cylinder, comprising:

monitoring a mass of fuel ingested by said cylinder during a detection period;

determining a steady state range based on an average of said mass of fuel over said detection period and a steady state threshold; and indicating FDSS if said mass of fuel remains within said steady state range during said detection period.

28. The method of claim 27 wherein said mass of fuel is a measured mass of fuel.

29. The method of claim 27 wherein said mass of fuel is a commanded mass of fuel.

30. The method of claim 27 wherein said detection period is at least one engine cycle.

31. The method of claim 27 further comprising:

monitoring an air to fuel (A/F) ratio within said cylinder; and monitoring a mass of air ingested by said cylinder.

32. The method of claim 31 wherein said mass of fuel is based on said A/F ratio and said mass of air ingested by said cylinder.

33. The method of claim 31 wherein said A/F ratio is shifted to be contemporaneous with an intake event of said cylinder during a current engine cycle.

34. The method of claim 31 wherein said mass of air ingested is shifted to be contemporaneous with a current A/F ratio.

* * * * *